US005886284A

United States Patent [19]

Will et al.

[11] Patent Number: 5,886,284

[45] Date of Patent: Mar. 23, 1999

[54] MISSILE SAFETY SYSTEM FOR ASSURING MINIMUM SAFE DISTANCE

[75] Inventors: Albert S. Will, Bethesda; Robert R. Wilson, Chillum, both of Md.

[73] Assignee: The United States of America as represented by the Secretary of the Navy, Washington, D.C.

[21] Appl. No.: 423,640

[22] Filed: Dec. 28, 1964

[51] Int. Cl.[6] ..... F42C 15/44; F42C 9/00; F42C 11/06

[52] U.S. Cl. ..... 102/206; 102/249; 102/264; 102/218

[58] Field of Search ..... 102/70.2, 71, 82, 102/249, 264, 206, 218, 216

[56] References Cited

U.S. PATENT DOCUMENTS

| | | | |
|---|---|---|---|
| 2,863,393 | 12/1958 | Sheeley | 102/249 |
| 2,938,461 | 5/1960 | Rabinow | 102/229 |
| 3,000,315 | 9/1961 | Anastasia et al. | 102/251 |
| 3,157,125 | 11/1964 | Lohmann | 102/249 |

OTHER PUBLICATIONS

Locke, Principles of Guided Missile Design, Van Nostrand Co., Inc., N.J, pp. 328–330, 1957.

*Primary Examiner*—Charles T. Jordan
*Assistant Examiner*—Christopher K. Montgomery

[57] ABSTRACT

An arming and safing system for a missile having an acceleration responsive mechanism for actuating a timing device upon launching to insure arming only after the passage of a predetermined period of time, and an omnidirectional impact switch for activating a dudding switch in case of missile impact at a distance less than a minimum safe distance from the launching vehicle.

3 Claims, 1 Drawing Sheet

MISSILE SAFETY SYSTEM FOR ASSURING MINIMUM SAFE DISTANCE

Figure 1:
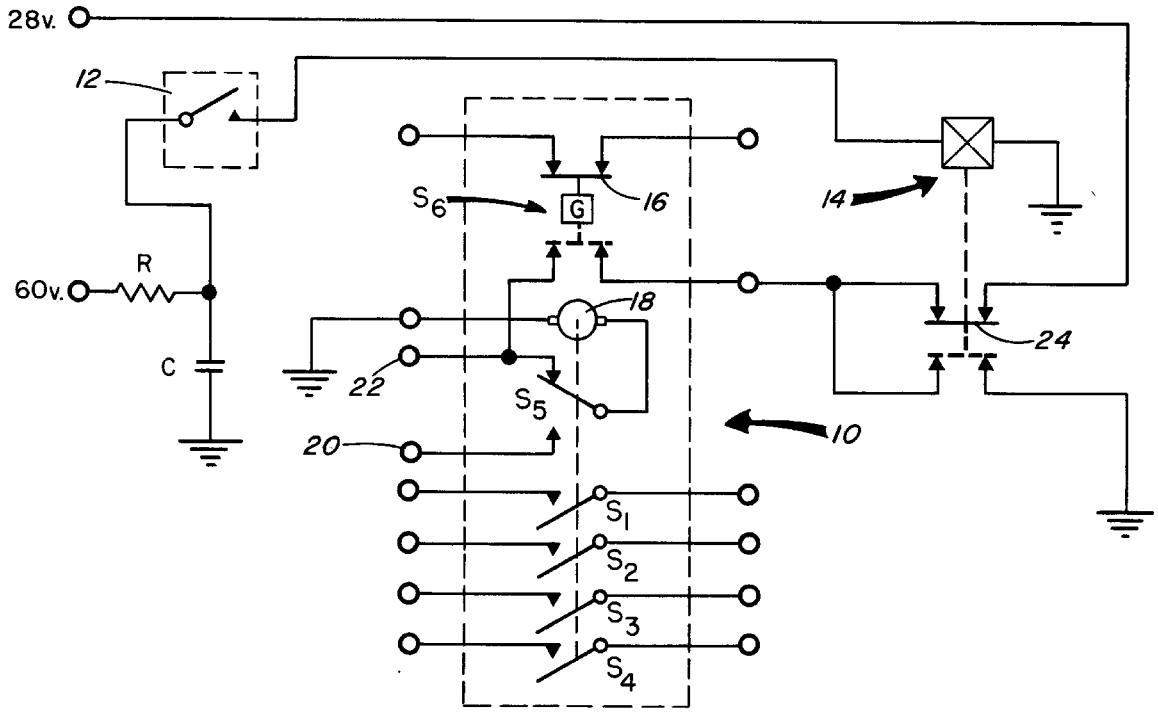

The invention described herein may be manufactured and used by or for the Government of the United States of America for governmental purposes without the payment of any royalties thereon or therefor.

The present invention is related to the art of the arming of ordnance missiles and more particularly to a safety system for assuring that a missile will not become armed unless it has attained a minimum safe distance of separation between itself and the launch site.

The invention to which the present application is directed was developed as part of the SUBROC weapon system although it will be clear from the detailed description to follow that it may be employed with any ordinary missile using delay arming. The SUBROC missile is an antisubmarine weapon provided with a nuclear warhead and designed to be launched from a torpedo tube of an attack submarine, to thereafter emerge from the water and go through an air boost phase depending upon the selected range, during which it is directed to the target area by terminal guidance, and then to re-enter the water in the vicinity of the target. Since such a warhead may have a lethal radius which is relatively close to the minimum operational range of the missile it is obvious that even slight missile malfunctions at any point in the trajectory, particularly in those cases when a short range is selected, could cause the re-entry body of the missile to enter the water at a location less than the minimum safe distance away from the launching submarine. For this reason and in order to assure a high level of safety for the launching submarine, it became necessary to incorporate as one of the many safety features of the weapon a positive and reliable safety system for preventing arming of the missile, or for dudding the missile, if it should undergo erratic flight which causes it to impact the water at a distance less than the minimum safe distance for the launching submarine.

Therefore, it is the purpose of this invention to provide such a missile safety system adapted particularly to a missile of the type described, but applicable also for general missile use.

Accordingly, an object of the present invention is to provide a safety and arming system for a missile which will delay the arming of the missile warhead until the missile, having been launched, is a safe distance from the launching site.

Another object of this invention is to provide a safety system for a missile of the type described which will delay the arming of the missile until after the missile has traversed a predetermined minimum safe distance and, in addition, will dud the missile if it impacts the water prior to achieving the minimum safe-separation.

In order to meet these objectives, a safety system has been developed which employs, in combination, a sensitive accelerometer, a motor-driven arming switch, an omni-directional impact switch and a dudding explosive switch. An assured safe distance can be measured by two integrations of acceleration or it can be approximated by measuring at least a minimum acceleration for at least a minimum time. The present system relies upon the latter method, which is often called pseudo-integration. If the missile impacts the water at a distance less than the minimum safe distance, the omni-directional impact switch will be activated to supply power to the dudding switch. On the other hand, if a predetermined minimum acceleration force is experienced by the missile for a predetermined minimum period of time during the boost phase it may be safely assumed that, barring gross aerodynamic failure, the missile will continue its flight and eventually reach a safe distance of separation, and it is only necessary thereafter to allow sufficient time for the missile to attain that separation. Accordingly, the motor-driven arming or timing switch of the present invention is actuated by the accelerometer under given conditions, and if permitted to run its full course prior to water impact it will short-circuit the connection between the impact switch and the dudding explosive switch.

Figure 2:
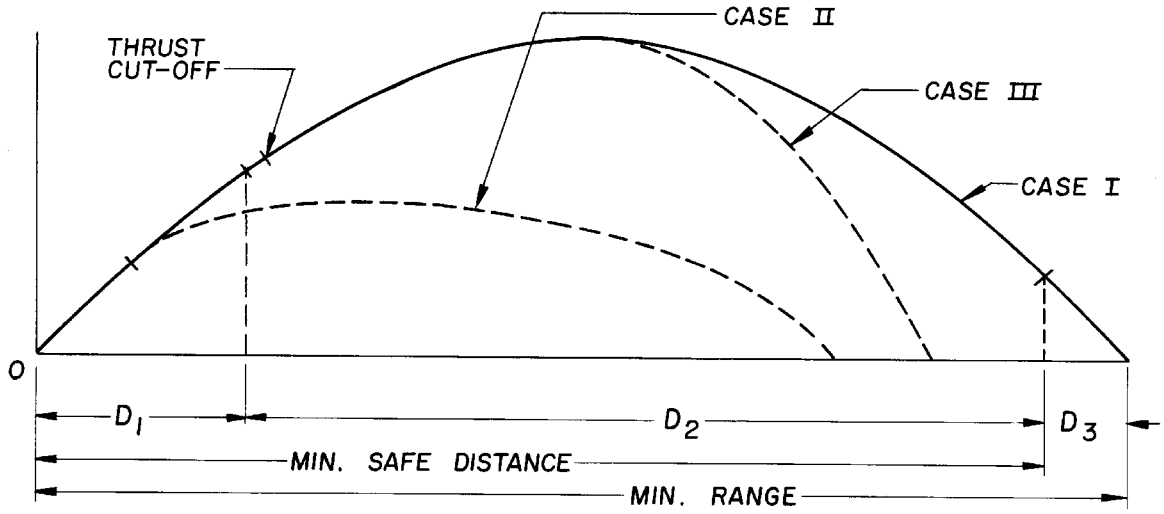

The novel features of the present invention, as well as additional objects and advantages thereof, will be better understood from the following detailed description when read in connection with the accompanying drawings wherein:

FIG. 1 is a schematic diagram illustrating one arrangement of the components of the safing and arming system of the present invention; and FIG. 2 is a schematic diagram depicting various missile trajectory paths and is illustrative of the manner in which the acceleration-impact safing system of the present invention operates.

Referring more particularly to the drawings, there is shown in FIG. 1 an acceleration integrating switch generally designated by the reference numeral 10, an omni-directional impact switch 12 and a dudding switch 14. Included within the accelerometer integrating switch 10 there is shown an inertial weight G connected to a pair of movable, lightweight, low-friction switching contacts 16, shown in an initial or monitor position, and responsive to missile acceleration for transferring the movable contacts 16 from the initial position to a circuit-closing position illustrated in dotted lines to thereby apply 28 volt missile power to a DC permanent magnet motor 18 for driving a set of movable switch contacts $S_1$, $S_2$, $S_3$, $S_4$ and $S_5$ in the arming circuits of the weapon toward the closed or armed positions. The back contact 20 on switch $S_5$ permits resetting of the acceleration integrating switch 10 to its zero or home position by special external test equipment, and the contact 22 is provided as a test point.

The acceleration switch generally indicated by the reference character $S_6$ in FIG. 1 and including the weight G and movable contacts 16 may be comprised of a verge-type, spring-loaded escapement mechanism which is designated to lock the movable contacts 16 in the arming position, illustrated by dotted lines, when the acceleration sensing element G has experienced a sustained force of acceleration greater than the design acceleration of the mechanism for a predetermined minimum period of time. If the design acceleration is not sustained for the full predetermined period of time, the mechanism driving movable contacts 16 causes them to return to their normally open initial position. A device suitable for this purpose is described in copending U.S. patent application Ser. No. 341,813, filed Jan. 31, 1964 by Charles Young, Jr. Obviously, however, many other well-known acceleration-responsive switching devices could be used with equal satisfaction in the present invention.

One of the basic requirements of the motor-driven switch forming part of the acceleration integrating switch 10 of the present invention and including motor 18 and switches $S_1$ through $S_5$ is that normally closed contacts will not be opened nor normally open contacts closed under the vibrations and shock to be encountered by the SUBROC missile. For this reason, switches $S_1$ through $S_5$ must be rugged switches, preferably of the rotary type having high contact pressures, having the demonstrated capability of withstanding the high shock loadings to be experienced by the re-entry body of the SUBROC missile during water impact.

Therefore, it may be observed that the acceleration integrating switch 10 is controlled by a sensitive acceleration switch $S_6$ having the ability to respond to low acceleration forces but must at the same time employ heavier, rugged, reliable arming contacts which, in this case, may be driven by an external power source via the motor 18 and an intermediate gear train, not illustrated.

In order to achieve arming with the present safety system the following sequence of events must occur:

During the boost phase in the missile trajectory, if the acceleration sensing element G experiences a sustained acceleration greater than the predetermined g-load for a period of time exceeding a predetermined time interval, the device will be committed and movable contacts 16 will become locked in the closed or arming position, whereupon 28 volt missile power is applied to motor 18 to drive the movable contacts in switches $S_1$ through $S_5$ toward the armed position. The time delay established by the sequential movement of the movable contacts of switches $S_1$ through $S_5$ to the armed position is such that on a normal trajectory the missile will not become armed until it has traveled a distance greater than the minimum safe distance. Upon closing of the switches $S_1$ through $S_4$ in the arming positions, switch $S_5$ opens, thereby removing the 28 volt missile power from the motor 18.

The above constitutes the normal operational sequence of the arming mechanism. For safing purposes, the aforedescribed arming mechanism does not adequately meet the requirement for guaranteeing the traversal of a minimum safe distance since the timing motor 18 could continue to run even if the missile re-entered the water prematurely. To prevent this, positive action is required to interrupt power to the arming motor. In accordance with the present invention this is accomplished through the provision of omnidirectional impact switch 12 and explosively-actuated dudding switch 14.

During the launching of the missile, 60 volt missile power is applied via an isolation resistor R thereby to charge capacitor C. After the exit from the water of the launched missile any impact of the missile occurring at water re-entry will cause impact switch 12 to activate thus closing its contacts, whereupon the stored energy from the charged capacitor C is applied to the explosive element of explosive dudding switch 14 to transfer the contacts 24 thereof as shown in dotted-line fashion, whereby the 28 volt power is removed from the timing motor input circuit and is connected instead to ground, thus positively preventing any stray voltages from inadvertently operating the motor to cause closure of the arming circuits.

Therefore, if the proper acceleration is not attained and sustained for a sufficient length of time, the movable contacts 16 of acceleration sensing device $S_6$ will be returned to their initial motor input circuit-opening position, thereby preventing any power form being applied to the arming motor 18. No arming thus occurs and the missile becomes a dud. Furthermore, upon water impact, power is removed from the contact of element $S_6$ controlling power to the motor through the explosive-actuated grounding thereof, thus guaranteeing positive dudding of the missile. The latter operation is necessary since the water entry shock conceivably could cause the unintended actuation of the acceleration switch $S_6$.

Referring now to FIG. 2, since the accelerometer of the present invention is a pseudo-integrator operating for all values above the design acceleration sustained for a given period, the minimum distance metered during boost phase to commit the mechanism is above a certain minimum, given by $D_1$. For the minimum range trajectory, boost phase cut-off occurs shortly after acceleration mechanism commit time. The delay time established by the motor driven timing mechanism is fixed such that the missile flying at its minimum possible velocity for the minimum range trajectory will achieve a minimum distance given by $D_2$ during the delay period. The sum of $D_1$ and $D_2$ then is the minimum safe distance. If a velocity less than this minimum velocity is experienced by the missile, it will re-enter the water prior to the completion of the arming cycle described herein.

For clarity in explaining the protection afforded by the safing system of the present invention, consider now the various trajectory paths shown in FIG. 2 and designated as Cases I, II and III.

Case I illustrates a normal trajectory for minimum range wherein arming is completed after the missile has traveled the minimum safe distance.

In case II the missile has not experienced a normal boost phase, and the acceleration sensing element $S_6$ did not commit, but instead returned to its initial position. No power was applied to the motor 18. In addition, upon water impact the omni-directional switch 12 operatively duds the arming motor 18 by connecting contacts 24 with ground and thereby removing power from the motor input circuit. As described hereinabove, this operation protects against the inadvertent movement of contacts 16 to the arming circuit-closing position by the premature water entry shock.

In case III the missile experiences a normal boost and flies normally for some portion of its ballistic trajectory, but through some missile malfunction enters the water prior to achieving the minimum safe-separation distance. Contacts 16 have been moved to the arming circuit-closing position and power has been supplied to motor 18. However, since the proper delay time has not expired, all switches $S_1$ through $S_5$ have not been actuated. Therefore the arming cycle has not been completed. Upon water impact the explosive dudding switch 14 removes power from the motor input circuit, stopping motor 18, and thereby preventing arming of the missile, which becomes a dud.

Obviously many modifications and variations of the present invention are possible in the light of the above teachings. It is therefore to be understood that within the scope of the appended claims, the invention may be practiced otherwise than as specifically described.

What is claimed is:

1. An arming and safing system for a missile carrying a nuclear warhead and for assuring a minimum safe-separation between the missile and the launching site prior to arming of the warhead, comprising, a timing device for completing the arming circuits of said warhead only after a predetermined time interval following actuation thereof, a motor for driving said timing device, a power source for said motor, circuit means connecting said power source to said motor and having therein a normally-open switch, acceleration-sensing means responsive only to a sustained acceleration of at least a predetermined level for at least a predetermined period of time for closing said normally-open switch, a normally-closed switch means in said circuit means positioned between said power source and said normally-open switch, and impact sensing means for opening said normally-closed switch, whereby if said missile impacts prior to having traveled a minimum safe distance from the launching site, power will be removed from the motor-driven timing device before the expiration of said predetermined arming-time interval and the missile will become a dud.

2. An arming and safing system for a missile having a warhead comprising, a motor driven timing device for arming the warhead at the completion of a predetermined period of time following actuation thereof, a power source for said motor, circuit means connecting said power source and said motor, normally open switch means in said circuit means, acceleration responsive means sensitive to the missile-launching-acceleration-forces for closing said normally open switch means and thereby actuating said motor driven timing device, dudding means including a normally closed explosively-actuated switch in said circuit means for disabling the timing device to prevent arming of the warhead, and impact sensing means for actuating said dudding means.

3. The system of claim 2 having a second circuit means comprising a second power source and the explosively-actuated switch of said dudding means, said second circuit means having therein a capacitor to be charged by said second power source, and a normally-open switch between said charging capacitor and said explosively-actuated switch, said normally-open switch in said second circuit being activated by said impact sensing means.

* * * * *